United States Patent [19]

Tanaka

[11] 4,387,062

[45] Jun. 7, 1983

[54] CARBURETOR FLOAT CHAMBER VENTING SYSTEM

[75] Inventor: Yoshiyuki Tanaka, Toyota, Japan

[73] Assignee: Toyota Jidosha Kabushiki Kaisha, Aichi, Japan

[21] Appl. No.: 341,263

[22] Filed: Jan. 21, 1982

[30] Foreign Application Priority Data

Jun. 17, 1981 [JP] Japan ..... 56-94495

[51] Int. Cl.[3] ..... F02M 5/08

[52] U.S. Cl. ..... 261/23 A; 261/DIG. 67; 261/DIG. 74; 261/72 R

[58] Field of Search ..... 261/DIG. 67, DIG. 74, 261/72 R, 23 A

[56] References Cited

U.S. PATENT DOCUMENTS 3,460,522 8/1969 Kittler et al. ..... 261/DIG. 67
3,548,797 12/1970 Hagihara et al. ..... 261/DIG. 67
4,157,366 6/1979 Ruth et al. ..... 261/DIG. 67
4,331,617 5/1982 Tamaki et al. ..... 261/DIG. 67

FOREIGN PATENT DOCUMENTS 54-17426 2/1979 Japan ..... 261/DIG. 67

*Primary Examiner*—Tim R. Miles
*Attorney, Agent, or Firm*—Stevens, Davis, Miller & Mosher

[57] ABSTRACT

A carburetor float chamber venting system includes an intake system float chamber venting passage which leads from an upper part of the carburetor float chamber to the intake system, a fuel vapor absorption device float chamber venting passage which leads from an intermediate part of the intake system float chamber venting passage to a fuel vapor absorption device, and a control valve, provided at a part of the fuel vapor absorption device float chamber venting passage, whose operation controls the opening and closing of the fuel vapor absorption device float chamber venting passage.

3 Claims, 4 Drawing Figures

CARBURETOR FLOAT CHAMBER VENTING SYSTEM

BACKGROUND OF THE INVENTION

The present invention relates to a carburetor float chamber venting system, and more particularly relates to a float chamber venting system for a carburetor of the sort which incorporates a fuel vapor absorption device such as a charcoal canister.

The float chamber of a carburetor for use in an internal combustion engine such as an engine for an automotive vehicle is generally vented at its upper portion, for the purpose of adjusting the pressure within said upper portion, so as to allow the normal and well known process of adjustment of the level of fuel within the float chamber and passing of this fuel into the intake throat or throats of the carburetor to continue without being interfered with by pressure variation in said upper portion of said float chamber. In view of the standards for prevention of emission of noxious components, and particularly of hydrocarbons such as evaporated gasoline, from internal combustion engines of motor vehicles, which are becoming more and more severe nowadays, it is usually practice for the upper part of the float chamber to be vented, in fact, to the intake throat of the carburetor, or more generally to the intake system of the engine at some point, via an intake system float chamber venting passage which leads from said upper part of the float chamber to said intake system. Thus, one end of said intake system float chamber venting passage is communicated to said upper part of the float chamber at a certain point of said upper part of said float chamber, while the other end of said intake system float chamber venting passage is communicated to said intake system of said engine.

Such an arrangement is effective for venting the upper part of the float chamber when the engine is being operated, and for disposing of the vapors that inevitably evaporate from the upper free surface of the fuel in the float chamber into said upper part thereof when the engine is being operated, but is however unsatisfactory with regard to the disposal of the vapors that also inevitably evaporate from the upper free surface of the fuel in the float chamber into said upper part thereof when the engine is not being operated, because such vapors may well pass from the intake system of the engine to which they have been conducted through said intake system float chamber venting passage from the upper part of the float chamber so as to escape to the outside atmosphere, since when the engine is not being operated of course such vapors are not sucked into the engine and combusted therein. Accordingly, it is commonly practiced to provide a device for absorbing such fuel vapors such as a charcoal canister, and to connect this fuel vapor absorption device to the upper part of the float chamber via a fuel vapor absorption device float chamber venting passage, which is provided independently of the abovementioned intake system float chamber venting passage. Thus, one end of said fuel vapor absorption device float chamber venting passage is communicated to said upper part of the float chamber at a point of said upper part of said float chamber somewhat removed from the aforesaid certain point of said upper part of said float chamber to which said one end of said intake system float chamber venting passage is communicated, while the other end of said fuel vapor absorption device float chamber venting passage is communicated to said fuel vapor absorption device.

This fuel vapor absorption device float chamber venting passage is kept closed when the engine is in operation by a valve of some sort or the like, so as to prevent the fuel vapors that inevitably evaporate from the upper free surface of the fuel in the float chamber into said upper part thereof when the engine is being operated from passing through said fuel vapor absorption device float chamber venting passage into said fuel vapor absorption device, and so as to force said vapors instead to pass through said intake system float chamber venting passage into said intake system of said engine so as to be combusted in said engine and thus disposed of; but on the other hand when the engine is stopped this fuel vapor absorption device float chamber venting passage is opened by the opening of said valve or the like, so as to allow the aforesaid fuel vapors that inevitably evaporate from the upper free surface of the fuel in the float chamber into said upper part thereof when the engine is not being operated to pass through said fuel vapor absorption device float chamber venting passage into said fuel vapor absorption device so as to be absorbed by an active absorbing substance such as activated charcoal contained therein. Thus, contamination of the atmosphere by the release of such fuel vapors, when the engine is not being operated, through the intake system float chamber venting passage into said intake system of said engine and thence to the atmosphere is positively prevented.

Such a carburetor float chamber venting system as described above is effective with regard to the prevention of contamination of the atmosphere by the release of fuel vapors when the engine is not being operated through the intake system float chamber venting passage and the intake system to the outside air, but a problem arises in its operation, as follows. When the engine is first switched off, so that the above mentioned valve or the like is opened from being closed, and so that the fuel vapor absorption device is newly communicated via the fuel vapor absorption device float chamber venting passage with the upper part of the float chamber, then, if the intake system float chamber venting passage remains open at this time, then a current of air may well be established, flowing from the intake system of the engine, through the intake system float chamber venting passage in the reverse direction to the previous flow of fuel vapors, over the surface of the fuel which is still remaining within the float chamber between said one end of said intake system float chamber venting passage and said one end of said fuel vapor absorption device float chamber venting passage, through said fuel vapor absorption device float chamber venting passage, and into the fuel vapor absorption device. This air current may be established, for instance, because of cooling of the fuel vapor absorption device and of contraction of the volume of the gas contained therein, or for other reasons. In any case, such an air current passing for any substantial length of time over the fuel remaining within the float chamber will have the very undesirable effect of preferentially evaporating the more volatile components of said fuel which is still remaining within the float chamber, so that the relative amount of less volatile components, or high boiling point components, in said fuel remaining within the float chamber is increased. Thus, the overall boiling point of the fuel remaining within the float chamber is increased, and this deteriorates starting of the engine. Further, this evaporation of said more volatile components of the fuel which is still remaining within the float chamber is rather wasteful of fuel, which is undesirable from the point of view of energy saving.

As a system to obviate this problem, there has been proposed a system in which through the use of another valve or the like, or through the use of a combination valve system, at or approximately at the time when the fuel vapor absorption device float chamber venting passage is opened, i.e. at or approximately at the time when the engine is stopped from operating, the intake system float chamber venting passage is closed. Such a system is reasonably straightforward if the fact that it requires another control valve and makes the float chamber venting system to that extent more complicated is disregarded. Further, in the case that only one such intake system float chamber venting passage is provided. However, nowadays many vehicles are equipped with so called duplex type carburetors which have both a primary fuel supply system and a secondary fuel supply system, and in such a carburetor there are typically provided two of such intake system float chamber venting passages, one leading from the upper part of the float chamber to the primary throat of the carburetor in the primary fuel supply system, and one leading separately from the upper part of the float chamber to the secondary throat of the carburetor in the secondary fuel supply system. In such a duplex carburetor, if the above mentioned solution to the problem of the establishment of an air current over the surface of the fuel remaining in the float chamber after the engine has been stopped, of controlling the intake system float chamber venting passage in inverse or opposite relation to the control of the fuel vapor absorption device float chamber venting passage, is adopted, then both of these two intake system float chamber venting passages have to be closed together as the fuel vapor absorption device float chamber venting passage is opened, and vice versa. This is more troublesome to do with only one control valve, and leads to great complication in the construction of the carburetor.

SUMMARY OF THE INVENTION

Accordingly, it is the primary object of the present invention to provide a carburetor float chamber venting system of the general sort outlined above, incorporating an intake system float chamber venting passage and a fuel vapor absorption device float chamber venting passage, in which there is no substantial risk of an air current being set up over the upper free surface of the fuel remaining in the float chamber after the engine incorporating the carburetor has been stopped.

It is a further object of the present invention to provide such a carburetor float chamber venting system, which does not run any substantial risk of evaporating an undesirably large amount of the more volatile or lower boiling point components of the fuel remaining in the float chamber after the engine incorporating the carburetor has been stopped.

It is a further object of the present invention to provide such a carburetor float chamber venting system, which does not run any substantial risk of causing the fuel remaining in the float chamber after the engine incorporating the carburetor has been stopped to contain a substantially increased amount of less volatile or lower boiling point components.

It is a further object of the present invention to provide such a carburetor float chamber venting system, which effectively prevents the venting to atmosphere of hydrocarbon fractions evaporated from the fuel in the carburetor, while the engine incorporating the carburetor is running.

It is a further object of the present invention to provide such a carburetor float chamber venting system, which effectively prevents the venting to atmosphere of hydrocarbon fractions evaporated from the fuel in the carburetor, after the engine incorporating the carburetor has been stopped.

It is a further object of the present invention to provide such a carburetor float chamber venting system, which is of a reasonably simple construction.

It is a further object of the present invention to provide such a carburetor float chamber venting system, which does not involve any unduly complicated switching valve system.

It is yet a further object of the present invention to provide such a carburetor float chamber venting system, which reduces the amount of fuel vapor absorbed by a fuel vapor absorption device.

It is a further object of the present invention to provide such a carburetor float chamber venting system, which allows a fuel vapor absorption device to be made smaller than has heretofore been the case.

It is yet a further object of the present invention to provide such a carburetor float chamber venting system which promotes good engine restartability, after the engine incorporating the carburetor has been stopped.

It is yet a further object of the present invention to provide such a carburetor float chamber venting system, which economizes on fuel utilization of the engine incorporating the carburetor, thus helping energy saving.

According to the present invention, these and other objects are accomplished by a carburetor float chamber venting system, for a carburetor comprising a float chamber for an internal combustion engine comprising an intake system and a fuel vapor absorption device, comprising: an intake system float chamber venting passage which leads from an upper part of said float chamber to said intake system; a fuel vapor absorption device float chamber venting passage which leads from an intermediate part of said intake system float chamber venting passage to said fuel vapor absorption device; and a control valve, provided at a part of said fuel vapor absorption device float chamber venting passage, whose operation controls the communication between said intermediate part of said intake system float chamber venting passage and said fuel vapor absorption device via said fuel vapor absorption device float chamber venting passage.

According to such a structure, when the fuel vapor absorption device float chamber venting passage is opened by said control valve so that said intermediate part of said intake system float chamber venting passage and said fuel vapor absorption device are communicated via said fuel vapor absorption device float chamber venting passage, then fuel vapors that inevitably evaporate from the upper free surface of the fuel in the float chamber when the engine is not being operated are able to pass through the part of said intake system float chamber venting passage which leads from said float chamber to its said intermediate part which is communicated to said fuel vapor absorption device float chamber venting passage, along said fuel vapor absorption device float chamber venting passage, and into said fuel vapor absorption device so as to be absorbed by an active absorbing substance contained therein. No danger exists of any air flow which may be generated from the outside atmosphere to the inside of said fuel vapor absorption device via said intake system float chamber venting passage and said fuel vapor absorption device float chamber venting passage passing into the float chamber and blowing across the upper surface of the fuel contained therein, because the air flow path which in practice is pursued by air flow effectively bypasses the float chamber and also in fact said part of said intake system float chamber venting passage which leads from said float chamber to its said part which is communicated to said fuel vapor absorption device float chamber venting passage. Accordingly, evaporation of the more volatile constituents of the fuel remaining within said float chamber after the engine has been stopped is not encouraged by any such air flow blowing across the upper surface of said fuel, and as explained previously this is helpful from the point of view of restartability of the engine, and also is economical of fuel.

Further, according to a particular aspect of the present invention, these and other objects are more particularly and concretely accomplished by a carburetor float chamber venting system as described above, said carburetor being a double barreled carburetor comprising a primary intake throat and a secondary intake throat, and said intake system float chamber venting passage being a primary intake system float chamber venting passage which leads from an upper part of said float chamber to said primary intake throat, further comprising a secondary intake system float chamber venting passage which leads from an upper part of said float chamber to said secondary intake throat.

According to such a structure, the carburetor float chamber venting device according to the present invention may be adapted for use with a double barreled or duplex carburetor, without making the control valve arrangement unduly complex.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENTS

Figure 1:
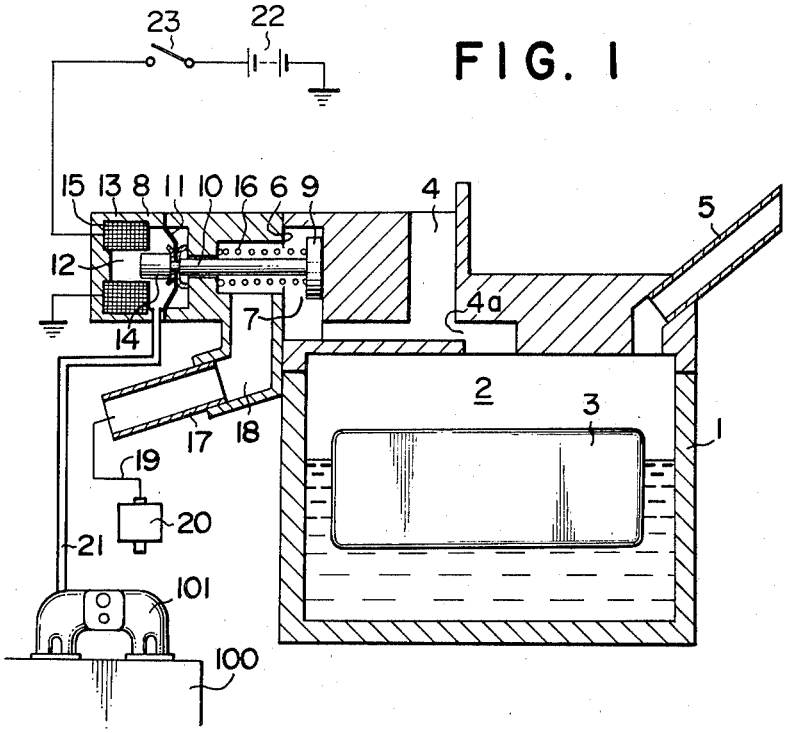
FIG. 1 is a schematic cross sectional view, showing a part of a carburetor including the float chamber thereof fitted to an internal combustion engine, and also partially showing other components relevant to a first preferred embodiment of the carburetor float chamber venting system according to the present invention, in which first preferred embodiment an end proximate to a float chamber of a fuel vapor absorption device float chamber venting passage is communicated to an intermediate part of a primary intake system float chamber venting passage which is on the other side of a bent portion of said primary intake system float chamber venting passage from said float chamber.

The present invention will now be described with reference to several preferred embodiments thereof, and with reference to the appended drawings. FIG. 1 is schematic cross sectional view, showing part of a carburetor, whose body is designated by the reference numeral 1, including a float chamber 2, and fitted to an internal combustion engine 100. This carburetor is equipped with a first preferred embodiment of the carburetor float chamber venting system according to the present invention. The float chamber 2 is supplied with liquid fuel such as gasoline through a conduit not shown in the figure by a fuel pump system also not shown in the figure, and a float 3 floats in the fuel within the float chamber 2 and regulates the level of this fuel within said float chamber 2 to approximately a predetermined level (while the internal combustion engine 100 is operating) in a per se well known feedback fashion, by controlling a needle valve and seat assembly or the like; these arrangements are not particularly shown in the figure, because they are per se well known and conventional and do not substantially relate to the gist of the present invention. Further, also in a per se well known way, a supply of this fuel within the float chamber 2 is taken out through a conduit not shown in the figure and is supplied to a fuel nozzle or nozzles (also not shown) which provide supply of fuel to the intake passage of the engine. In fact, in the shown system, as will be seen later the carburetor is a duplex or two barreled carburetor, and accordingly at least two such nozzles are provided, at least one opening into the primary throat and at least one opening into the secondary throat; but the fuel supply arrangements of the carburetor are not strictly relevant to the present invention.

Formed within the carburetor body 1 are a primary intake system float chamber venting passage 4 and a secondary intake system float chamber venting passage 5. The lower ends in FIG. 1 of the primary and secondary intake system float chamber venting passages 4 and 5 both communicate to the upper part of the float chamber 2, i.e. to the part of said float chamber 2 which is not filled with liquid fuel when the internal combustion engine 100 is operating but which is above the free upper surface of the liquid fuel in said float chamber 2; and the end (not shown in the figure) remote from the float chamber 2 of the primary intake system float chamber venting passage 4 is communicated to the primary throat of the carburetor (also not shown), while the end (also not shown in the figure) remote from the float chamber 2 of the secondary intake system float chamber venting passage 5 is communicated to the secondary throat of the carburetor (also not shown). Further, formed within the carburetor body 1 is a fuel vapor absorption device float chamber venting passage 7. The end remote from the float chamber 2 of the fuel vapor absorption device float chamber venting passage 7 is communicated to a valve port 6, to the other side of which there is communicated one end of a passage 18. The other end of the passage 18 is communicated to one end of a connection pipe 17, the other end of which is connected to one end of a conduit 19. The other end of the conduit 19 is connected to the inlet of a fuel vapor absorption device, which in this shown first preferred embodiment of the present invention is a charcoal canister 20 of a per se well known sort. Particularly according to the present invention, the end more towards the float chamber 2 of the fuel vapor absorption device float chamber venting passage 7 is communicated to an intermediate portion of the primary intake system float chamber venting passage 4. In this first preferred embodiment of the carburetor float chamber venting system according to the present invention, just downstream of the point of the primary intake system float chamber venting passage 4 to which said fuel vapor absorption device float chamber venting passage 7 is communicated, said primary intake system float chamber venting passage 4 is formed with a bent portion 4*a*, and accordingly the charcoal canister 20 can only communicate with the upper space in the float chamber 2 (via the conduit 19, the connection pipe 17, the passage 18, the valve port 6, and the fuel vapor absorption device float chamber venting passage 7) through said bent portion 4*a* of the primary intake system float chamber venting passage 4.

The opening and closing of the valve port 6 is controlled by a valve member 9, which is mounted on the right hand end in the figure of a valve shaft 10. The combination of the valve member 9 and the valve shaft 10 is biased in the rightward direction in the figure by a compression coil spring 16, so as to move the valve member 9 away from the valve port 6. On the other hand, the left hand end in the figure of the valve shaft 10 passes through a hole in the center of a diaphragm 11, to which it is axially fixed in a vacuum sealing manner, and then projects towards a solenoid device 13 and is formed as a solenoid element 14. The outer periphery of the diaphragm 11 is sealingly fitted to the inner surface of a diaphragm chamber 12 formed in the carburetor body 1, and vacuum is supplied to this diaphragm chamber 12 (on the side of the diaphragm 11 remote from the valve member 9, i.e. the left side thereof) from the inlet manifold 101 of the internal combustion engine 100, when said vacuum is present in said inlet manifold 101, via a vacuum conduit 21. Finally, the coil 15 of the solenoid device 13 is supplied selectively with actuating electrical energy from the battery 22 of the vehicle to which this carburetor and this internal combustion engine 100 are fitted, via the ignition switch 23 which controls said internal combustion engine 100.

Thus, when either vacuum is supplied to the diaphragm chamber 12 defined on the left side of the diaphragm 11 from the inlet manifold 101 of the internal combustion engine 100, or actuating electrical energy is supplied to the coil 15 of the solenoid device 13, the combination of the valve member 9 and the valve shaft 10 is moved in the leftward direction in the figure against the biasing action of the compression coil spring 16 which is overcome, so as to move the valve member 9 against the valve port 6 and so as to close the valve port 6 and to isolate the passage 18 from the fuel vapor absorption device float chamber venting passage 7; but, when neither vacuum is supplied to the diaphragm chamber 12 defined on the left side of the diaphragm 11 from the inlet manifold 101 of the internal combustion engine 100, nor actuating electrical energy is supplied to the coil 15 of the solenoid device 13, the combination of the valve member 9 and the valve shaft 10 is moved in the rightward direction in the figure by the biasing action of the compression coil spring 16, so as to move the valve member 9 away from the valve port 6 and so as to open the valve port 6 and to communicate the passage 18 with the fuel vapor absorption device float chamber venting passage 7. In other words, when either vacuum is present in the inlet manifold 101, or the ignition switch 23 which controls the internal combustion engine 100 is closed, then the valve port 6 is closed and the passage 18 is isolated from the fuel vapor absorption device float chamber venting passage 7; but, when both no vacuum is present in the inlet manifold 101, and also the ignition switch 23 which controls the internal combustion engine 100 is open, then the valve port 6 is opened and the passage 18 is communicated to the fuel vapor absorption device float chamber venting passage 7.

The operation of this first preferred embodiment of the carburetor float chamber venting system according to the present invention is as follows.

When the internal combustion engine 100 is running, then both vacuum is present in the inlet manifold 101 of the internal combustion engine 100 and the ignition switch 23 which controls the internal combustion engine 100 is closed, and according to this both vacuum is supplied to the diphragm chamber 12 defined on the left side of the diaphragm 11 from the inlet manifold 101 of the internal combustion engine 100, and also actuating electrical energy is supplied to the coil 15 of the solenoid device 13. Therefore according to the actions both of the diaphragm 11 and of the solenoid device 13, which cooperate, the combination of the valve member 9 and the valve shaft 10 is moved in the leftward direction in the figure against the biasing action of the compression coil spring 16 which is overcome, so as to move the valve member 9 against the valve port 6 and so as to close the valve port 6 and to isolate the passage 18 from the fuel vapor absorption device float chamber venting passage 7, quite definitely and positively. Accordingly, none of the vapors which inevitably evaporate from the upper free surface of the fuel in the float chamber 2 into the upper part thereof when the internal combustion engine 100 is being operated are not at this time able to pass through the fuel vapor absorption device float chamber venting passage 7, the passage 18, and the conduit 19 into the fuel vapor absorption device 20, and said vapors are instead forced to pass through the primary and secondary intake system float chamber venting passages 4 and 5 into the intake system of the internal combustion engine 100 so as to be combusted in said internal combustion engine 100 and thus disposed of; and the pressure in said upper part of the float chamber 2 is automatically adjusted to correspond to the pressure in said intake system of said internal combustion engine 100. Thus, the fuel supply characteristics of the carburetor are prevented from undesirably changing significantly in response to the amount of flow of intake air.

On the other hand, when the internal combustion engine 100 is stopped, then both vacuum ceases to be present in the inlet manifold 101 of the internal combustion engine 100 and also the ignition switch 23 which controls the internal combustion engine 100 is now opened, and according to this both vacuum ceases to be supplied to the diaphragm chamber 12 defined on the left side of the diaphragm 11 from the inlet manifold 101 of the internal combustion engine 100, and also actuating electrical energy ceases to be supplied to the coil 15 of the solenoid device 13. Therefore since neither the diaphragm 11 nor the solenoid device 13 at this time provides any action to move the combination of the valve member 9 and the valve shaft 10 in the leftward direction in the figure against the biasing action of the compression coil spring 16, therefore according to this baising action of the compression coil spring 16 and combination of the valve member 9 and the valve shaft 10 is moved in the rightward direction in the figure, so as to move the valve member 9 away from the valve port 6 and so as to open the valve port 6 and so as to communicate the passage 18 to the fuel vapor absorption device float chamber venting passage 7, quite definitely and positively. Accordingly, the vapors which inevitably evaporate from the upper free surface of the fuel in the float chamber 2 into the upper part thereof when the internal combustion engine 100 is thus not being operated are at this time able to pass through the part of the primary intake system float chamber venting passage 4 proximate to the float chamber 2 and past the bent portion **4*a* thereof to pass, past the valve port 6, into the fuel vapor absorption device float chamber venting passage 7, and thence through the passage 18 and the conduit 19 into the fuel vapor absorption device 20, which absorbs them. Later, in fact, these absorbed fuel vapors are purged from the fuel vapor absorption device 20 by a purging system of a per se well known sort, which releases them into the intake system of the interal combustion engine 100 to be combusted therein while said internal combustion engine 100** is running; but this is not directly relevant to the present invention.

At this time, there exists no danger such as existed in the prior art of a current of air becoming established, flowing from the intake system of the engine, through the primary and/or secondary intake system float chamber venting passages 4 and/or 5 in the reverse direction to the previously described flow of fuel in said passages while the internal combustion engine 100 was running, over the surface of the fuel which is still remaining within the float chamber 2 between the end connected to said float chamber 2 of said primary intake system float chamber venting passage 4 and/or the end connected to said float chamber 2 of said secondary intake system float chamber venting passage 5 and the end proximate to said float chamber 2 of said fuel vapor absorption device float chamber venting passage 7, through said fuel vapor absorption device float chamber venting passage 7, and into the fuel vapor absorption device 20, because for instance of cooling of the fuel vapor absorption device 20 and of contraction of the volume of the gas contained therein, or for other reasons, because said end proximate to said float chamber 2 of said fuel vapor absorption device float chamber venting passage 7 is not in fact communicated directly to said float chamber 2, but is instead communicated to an intermediate part of said primary intake system float chamber venting passage 4, on the other side of the bend portion **4*a* thereof from said float chamber 2. According, any air current which is established as passing into said fuel vapor absorption device 20 through said fuel vapor absorption device float chamber venting passage 7 from the outside atmosphere via said primary intake system float chamber venting passage 4 in fact does not pass over the surface of the fuel which is still remaining within the float chamber 2 at all, and accordingly such a flow of air, even if it persists for a substantial length of time, because it is not blowing over the fuel remaining within the float chamber 2, has no such undesirable effect of preferentially evaporating the more volatile components of said fuel which is still remaining within the float chamber 2 so that the relative amount of less volatile components in said fuel remaining within the float chamber 2** is increased, or of thus deteriorating starting of the engine, as was present in prior art carburetor float chamber venting systems as described above. Further, because there is caused no such evaporation of said more volatile components of the fuel which is still remaining within the float chambers, such fuel is not thereby wasted, which is desirable from the point of view of energy saving.

If a flow or current of air is established at this time as flowing through the primary and/or secondary intake system float chamber venting passages 4 and/or 5 into the vacant space in the upper part of the float chamber 2, then since the pressures at the ends remote from the float chamber 2 of these primary and secondary intake system float chamber venting passages 4 and 5 are substantially equal (these are of course just the pressure in the intake system of the internal combustion engine 100, which at this time as stated above is substantially atmospheric pressure, since the internal combustion engine 100 is not running at this time), such flows will be set up in both the primary intake system float chamber venting passage 4 and in the secondary intake system float chamber venting passage 5 at the same time, in unison, and therefore no flow will be caused over the upper free surface of the fuel remaining in the float chamber 2 while the internal combustion engine 1 is stopped to pass out of the float chamber 2, and hence none of the more volatile components of said fuel remaining in the float chamber 2 while the internal combustion engine 1 is stopped will be taken by such a flow out of the float chamber 2. In other words, because the end proximate to the float chamber 2 of the fuel vapor absorption device float chamber venting passage 7 is arranged as communicating, not as was the case in the prior art directly into the float chamber 2, but instead to an intermediate part of the primary intake system float chamber venting passage 4, thus no air flow can be set up over the surface of the fuel remaining in the float chamber 2 while the internal combustion engine 1 is stopped to carry vaporized lower boiling point constituents of said fuel into the charcoal canister 20. Accordingly the overall boiling point of the fuel remaining within the float chamber is not particularly increased when the engine is stopped for some time, and thus starting of the engine is not thereby deteriorated. Further, this lack of evaporation of said more volatile components of the fuel which is still remaining within the float chamber is desirable from the point of view of energy saving, and also means that it is possible to use a smaller charcoal canister 20 than has been the case in the prior art, since said charcoal canister 20 is not required to dispose of such a large amount of fuel vapors at one time before being purged.

It should be noted that it is possible, as shown in FIG. 1, for the opening end of the fuel vapor absorption device float chamber venting passage 7 to be arranged as the highest part of the path between the charcoal canister 20 and the float chamber 2. Accordingly, when the valve port 6 is closed by the valve element 9, there is no risk of any liquid fuel remaining as accumulated within any part of this part, since it is well drained by the force of gravity, either to the charcoal canister 20 or to the float chamber 2, and cannot lie in any well defined in said path.

Figure 2:
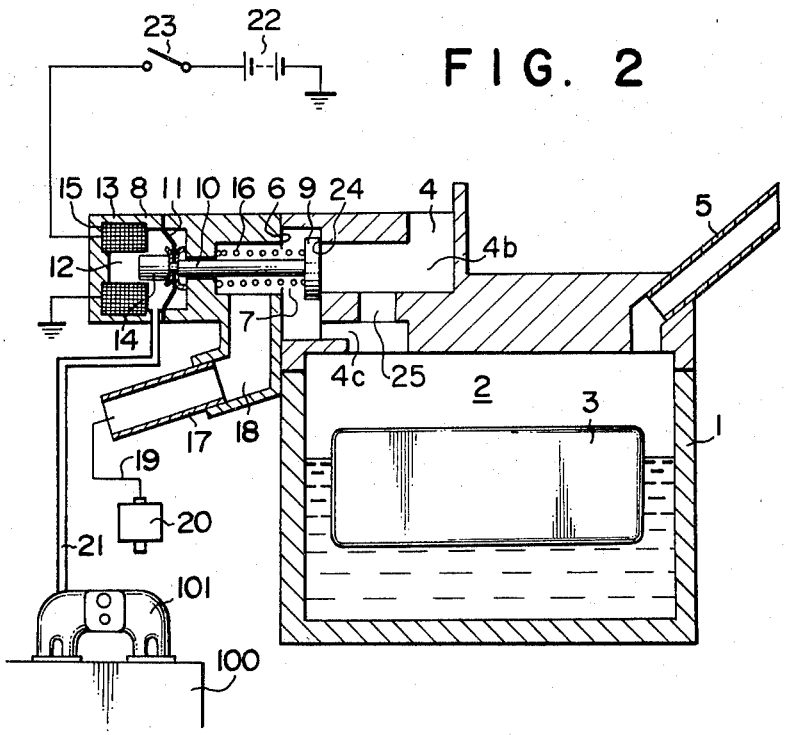
FIG. 2 is a schematic cross sectional view, similar to FIG. 1, showing a part of a carburetor including the float chamber thereof fitted to an internal combustion engine, and also partially showing other components relevant to a second preferred embodiment of the carburetor float chamber venting system according to the present invention, in which second preferred embodiment a control valve is a two way control valve and the end of a bypass passage nearest to the float chamber directly opposes an opening which leads to said float chamber.

In FIG. 2, there is shown a second preferred embodiment of the carburetor float chamber venting system according to the present invention, in a fashion similar to FIG. 1. In FIG. 2, parts, apertures, spaces, and passages of the second preferred embodiment shown, which correspond to parts, apertures, spaces, and passages of the first preferred embodiment shown in FIG. 1, and which have the same functions, are designated by the same reference numerals and symbols as in that figure.

In this second preferred embodiment, when the combination of the valve member 9 and the valve shaft 10 is moved in the rightward direction in the figure by the biasing action of the compression coil spring 16, so as to move the valve member 9 away from the valve port 6 and so as to open the valve port 6 and so as to communicate the passage 18 to the fuel vapor absorption device float chamber venting passage 7, at the same time said valve member 9 is pressed against a second valve port 24, which communicates between a portion **4*b* of the primary intake system float chamber venting passage 4 remote from the float chamber 2 and said fuel vapor absorption device float chamber venting passage 7, so as to close said second valve port 24. Thus, the fuel vapor absorption device float chamber venting passage 7 alternatively is either communicated via the first valve port 6 to the passage 18 and therethrough to the charcoal canister 20, or is communicated via the second valve port 24 to said portion 4*b* of the primary intake system float chamber venting passage 4 remote from the flat chamber 2, respectively according as to whether either vacuum is present in the inlet manifold 101 or the ignition switch 23 which controls the internal combustion engine 100 is closed, or alternatively both no vacuum is present in the inlet manifold 101 and also the ignition switch 23 which controls the internal combustion engine 100 is open. Further, said portion 4*b* of the primary intake system float chamber venting passage 4 remote from the float chamber 2 is communicated to a portion 4*c* of the primary intake system float chamber venting passage 4 proximate to the float chamber 2 which directly communicates to said float chamber 2, by a communicating passage 25. In this second preferred embodiment, the end of this communicating passage 25 which opens to said portion 4*c* of the primary intake system float chamber venting passage 4 proximate to the float chamber 2 in fact directly opposes the communicating opening between said portion 4*c* of said primary intake system float chamber venting passage 4 and said float chamber 2. Further, in this second embodiment, the part of said portion 4*c* of the primary intake system float chamber venting passage 4 proximate to the float chamber 2 between said end of the communicating passage 25 which joins to said portion 4*c* and said fuel vaor absorption device float chamber venting passage 7** is formed as fairly restricted in size.

It will be clear to one of ordinary skill in the carburetor art, based upon the above disclosure, that substantially the same functions and advantages are available with this second preferred embodiment of the carburetor float chamber venting system according to the present invention, as were available with the first preferred embodiment shown in FIG. 1 and described above. However, in this second embodiment it is effected that the primary intake system float chamber venting passage 4 is more restricted when the engine is stopped than when the engine is operating, so that escape of fuel vapor from the float chamber through the primary intake system float chamber venting passage 4 during engine stoppage is effectively suppressed.

Figure 3:
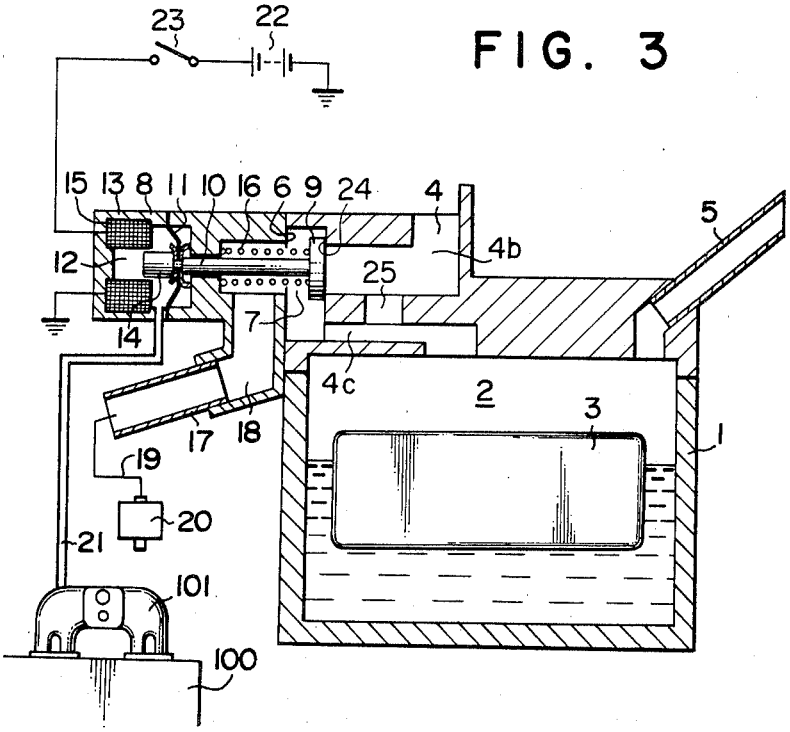
FIG. 3 is a schematic cross sectional view, similar to FIGS. 1 and 2, showing a part of a carburetor including the float chamber thereof fitted to an internal combustion engine, and also partially showing other components relevant to a third preferred embodiment of the carburetor float chamber venting system according to the present invention, in which third preferred embodiment a control valve is a two way control valve and the end of a bypass passage nearest to the float chamber does not directly oppose an opening which leads to said float chamber, but is somewhat removed therefrom.

In FIG. 3, there is shown a third preferred embodiment of the carburetor float chamber venting system according to the present invention, in a fashion similar to FIG. 1 and FIG. 2. In FIG. 3, parts, apertures, spaces, and passages of the third preferred embodiment shown, which correspond to parts, apertures, spaces, and passages of the first and second preferred embodiments shown in FIG. 1 and in FIG. 2, and which have the same functions, are designated by the same reference numerals and symbols as in those figures.

In this third preferred embodiment, the only difference from the second preferred embodiment shown in FIG. 2 is that the end of the communicating passage 25 which opens to said portion **4*c* of the primary intake system float chamber venting passage 4 promixate to the float chamber 2 does not directly oppose the communicating opening between said portion 4*c* of said primary intake system float chamber venting passage 4 and said float chamber 2, as was the case in the second preferred embodiment shown in FIG. 2. It will be clear to one of ordinary skill in the carburetor art, based upon the above disclosure, that substantially the same functions and advantages are available with this third preferred embodiment of the carburetor float chamber venting system accordng to the present invention, as well available with the free and second preferred embodiments shown in FIGS. 1 and 2 are described above. However, the third embodiment will provide a slightly modified operation when compared with the second embodiment with respect to the balance between the air drawn through the primary intake system float chamber venting passage 4 toward the charcoal canister 20 and the fuel vapor drawn from the upper part of the float chamber 2 toward the charcoal canister 20**.

Figure 4:
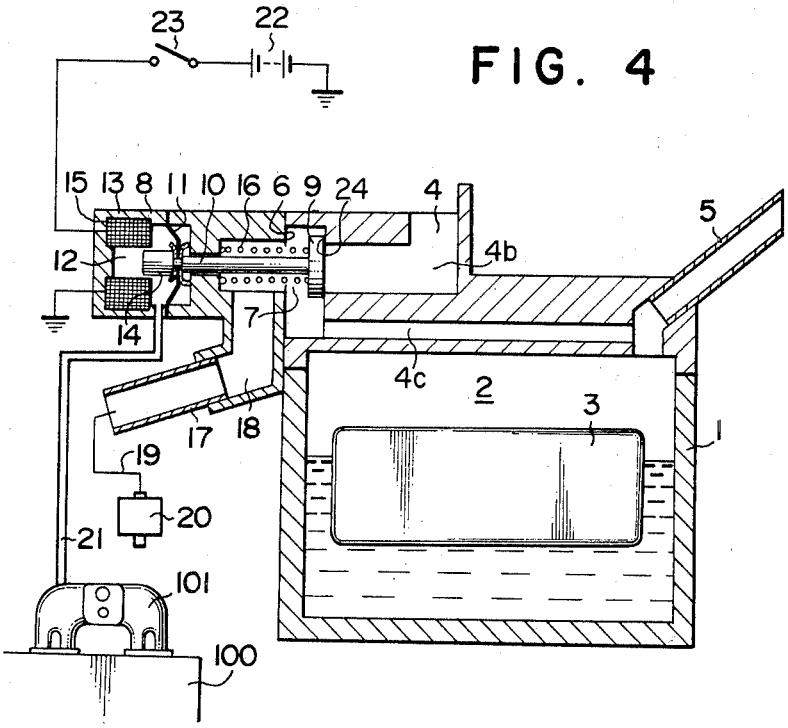
FIG. 4 is a schematic cross sectional view, similar to FIGS. 1, 2, and 3, showing a part of a carburetor including the float chamber thereof fitted to an internal combustion engine, and also partially showing other components relevant to a fourth preferred embodiment of the carburetor float chamber venting system according to the present invention, in which fourth preferred embodiment the end of said primary intake system float chamber venting passage which leads to said float chamber is in fact communicated to a part of a secondary intake system float chamber venting passage proximate to a part thereof which is communicated to said float chamber.

In FIG. 4, there is shown a fourth preferred embodiment of the caburetor float chamber venting system according to the present invention, in a fashion similar to FIGS. 1-3. In FIG. 4, parts, apertures, spaces, and passages of the fourth preferred embodiment shown, which correspond to parts, apertures, spaces, and passages of the first through third preferred embodiments shown in FIGS. 1–3, and which have the same functions, are designated by the same reference numerals and symbols as in those figures.

In this fourth preferred embodiment, the only difference from the second preferred embodiment shown in FIG. 2 is that no communicating passage such as the communicating passage 25 is provided, so that when the combination of the valve member 9 and the valve shaft 10 is moved in the rightward direction in the figure by the biasing action of the compression coil spring 16, so as to move the valve member 9 away from the valve portion 6 and so as to open the valve port 6 and so as to communicate the passage 18 to the fuel vapor absorption device float chamber venting passage 7 and so as simultaneously to press said valve member 9 against said second valve port 24 which communicates between said portion 4*b* of the primary intake system float chamber venting passage 4 remote from the float chamber 2 and said fuel vapor absorption device float chamber venting passage 7 so as to close said second valve port 24, said primary intake system float chamber venting passage 4 is thereby completely discommunicated from said float chamber 2. Further, the end of said portion 4*c* of said primary intake system float chamber venting passage 4 proximate to said float chamber 2 does not in fact communicate directly to said float chamber 2, but instead communicates to a point on said secondary intake system float chamber venting passage 5 near to the point where said secondary intake system float chamber venting passage 5 is communicated to said float chamber 2.

Again, it will be clear to one of ordinary skill in the carburetor art, based upon the above disclosure, that substantially the same functions and advantages are available with this fourth preferred embodiment of the carburetor float chamber venting system according to the present invention, as were available with the first, second, and third preferred embodiments shown in FIGS. 1, 2, and 3 and described above. However, in this fourth embodiment, it is effected that the primary intake system float chamber venting passage 4 is completely interrupted when the engine is stopped.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. A carburetor float chamber venting system, for a double barreled carburetor having a primary throat, a secondary throat and a float chamber and adapted to supply fuel-air mixture to an internal combustion engine having an intake system, a fuel vapor absorption device, and an ignition switch, comprising:

a primary intake system float chamber venting passage which leads from an upper part of said float chamber to said primary throat;

a secondary intake system float chamber venting passage which leads from a first intermediate part of said primary intake system float chamber venting passage to said secondary throat;

a fuel vapor absorption device float chamber venting passage which leads from a second intermediate part of said primary intake system float chamber venting passage located on the remote side of said first intermediate part thereof as viewed from said upper part of said float chamber to said fuel vapor absorption device; and a control valve, provided at a part of said fuel vapor absorption device float chamber venting passage, whose operation controls the communication and interception between said second intermediate part of said primary intake system float chamber venting passage and said fuel vapor absorption device via said fuel vapor absorption device float chamber venting passage.

2. A carburetor float chamber venting system according to claim 1, wherein said control valve is adapted to isolate a part of said primary intake system float chamber venting passage located on the remote side of said second intermediate part thereof as viewed from said upper part of said float chamber from said second intermediate part thereof when said control valve communicates said fuel vapor absorption device to said second intermediate part of said primary intake system float chamber venting passage via said fuel vapor absorption device float chamber venting passage.

3. A carburetor float chamber venting system according to claim 1, wherein said control valve includes an electromagnetic acutator adapted to be actuated when the ignition switch of the engine is closed and a fluid pressure actuator adapted to be actuated by intake vacuum of the engine, and is operated so as to isolate said fuel vapor absorption device from said second intermediate part of said primary intake system float chamber venting passage when at least one of said two actuators is actuated.

* * * * *